US010273680B2

(12) United States Patent
Massa et al.

(10) Patent No.: US 10,273,680 B2
(45) Date of Patent: Apr. 30, 2019

(54) SLIDING BEARING FOR SUPPORTING CIVIL OR STRUCTURAL ENGINEERING WORKS

(71) Applicant: TENSACCIAI S.R.L., Milan (IT)

(72) Inventors: Luigi Massa, Guidonia (IT); Ivan Marenda, Basiglio (IT)

(73) Assignee: TENSACCIAI S.R.L., Milan (IT)

( * ) Notice: Subject to any disclaimer, the term of this patent is extended or adjusted under 35 U.S.C. 154(b) by 0 days.

(21) Appl. No.: 15/740,122

(22) PCT Filed: Jul. 20, 2016

(86) PCT No.: PCT/IB2016/054319

§ 371 (c)(1),
(2) Date: Dec. 27, 2017

(87) PCT Pub. No.: WO2017/013600

PCT Pub. Date: Jan. 26, 2017

(65) Prior Publication Data

US 2018/0195267 A1 Jul. 12, 2018

(30) Foreign Application Priority Data

Jul. 20, 2015 (IT) ..... 102015000036011

(51) Int. Cl.

| | |
|---|---|
| ***E04B 1/36*** | (2006.01) |
| ***E04H 9/02*** | (2006.01) |
| ***E01D 19/04*** | (2006.01) |

(52) U.S. Cl.

CPC ..... *E04B 1/36* (2013.01); *E01D 19/04* (2013.01); *E04H 9/021* (2013.01)

(58) Field of Classification Search

CPC ..... E04B 1/36; E01D 19/04; E04H 9/021
See application file for complete search history.

(56) References Cited

U.S. PATENT DOCUMENTS 6,245,836 B1 6/2001 Nakamaru et al.

FOREIGN PATENT DOCUMENTS

| | | |
|---|---|---|
| JP | 2001-012542 A | 1/2001 |
| JP | 2001-132757 A | 5/2001 |
| JP | 2007-016905 A | 1/2007 |

OTHER PUBLICATIONS

International Search Report for PCT/IB2016/054319 dated Nov. 2, 2016 [PCT/ISA/210].

(Continued)

*Primary Examiner* — Patrick J Maestri
(74) *Attorney, Agent, or Firm* — Sughrue Mion, PLLC

(57) ABSTRACT

A sliding bearing, arranged for supporting civil or structural engineering works, such as for example bridges or buildings, seismically isolated or not, where the bearing comprises A) a base (3) and an upper support (5); B) a sliding element (7, 7') interposed between the base (3) and the upper support, and against which the base (3) and the upper support rest. The sliding element (7, 7') comprises at least one layer (11, 11', 11", 11$^{III}$) made of a sliding material (9) comprising in turn B.1) a content by weight equal to or greater than 50% wt of one or more fluorinated polymers; B.2 a content by weight comprised between 1-20% wt of boron nitride in hexagonal form. The mechanical properties of the sliding material (9) for use as a structural bearing or an anti-seismic isolator, are less sensitive to a temperature and environmental humidity with respect to known sliding materials.

17 Claims, 4 Drawing Sheets

(56) References Cited

OTHER PUBLICATIONS

Written Opinion for PCT/IB2016/054319 dated Nov. 2, 2016 [PCT/ISA/237].

SLIDING BEARING FOR SUPPORTING CIVIL OR STRUCTURAL ENGINEERING WORKS

CROSS REFERENCE TO RELATED APPLICATIONS

This application is a National Stage of International Application No. PCT/IB2016/054319 filed Jul. 20, 2016, claiming priority based on Italian Patent Application No. 102015000036011 filed Jul. 20, 2015, the contents of all of which are incorporated herein by reference in their entirety.

FIELD OF THE INVENTION

The present invention relates to a sliding bearing suitable for supporting civil or structural engineering works, such as for example buildings, without or with seismic base isolation, bridges, silos, tanks or large-dimension cranes, nuclear reactors or components thereof.

PRIOR ART

For supporting constructions such as bridges, buildings and other civil engineering works, etc., accommodating thermal deformations of the structure, movements of the land the building stands on and the relative movements between the parts of the structure itself due to the service loads (such as for example traffic on a bridge), or mitigating the effects of an earthquake on a structure, isolating said construction from the motion of the ground, at present anti-seismic isolators and bearings are known having various mechanical realisations, but sharing the principle of providing for, in design conditions, the sliding of two or more surfaces, of which at least one made of an appropriate sliding material characterised by a suitable coefficient of friction and high resistance to wear and to mechanical stresses, in particular to pressure.

The first material to be used as a sliding material was polytetrafluoroethylene (PTFE).

Some among the main limits of pure PTFE are the low compressive strength and resistance to wear. To increase compressive strength, it is known to add appropriate fillers, which however excessively increase the coefficient of friction and make the material too little ductile.

To bring the coefficient of friction back to acceptable values, it is known also to add solid lubricants to the PTFE, which nevertheless concur in further decreasing the ductility of the material too.

Subsequently various types of ultra-high molecular weight polyethylene have been proposed, i.e. UHMWPE (Ultra High Molecular Weight Polyethylene). The use of UHMWPE as a sliding material in structural bearings is described for example in publications GB2359345 and EP1523598A1.

This material can provide a compressive strength higher than the pure PTFE, with a notable impact on the technology of bearings since the same device, given an equal load, if realised with an appropriate UHMWPE, can have a size, and therefore a cost, significantly lower with respect to the device realised with PTFE.

UHMWPE was used as a sliding material also in anti-seismic isolators known as pendulum isolators (friction pendulum), such as the one described for example in publication U.S. Pat. No. 4,644,714. The UHMWPE however has a low softening temperature—around 135° C.—hence its mechanical strength with increasing temperature' decreases more rapidly with respect to PTFE.

To overcome the poor resistance to heat of UHMWPE and, to a lesser extent also of PTFE, a new sliding material has been developed, polyamide PA6, described for example in publication WO 2009/010487A1.

PA6 has a higher compressive strength and resistance to high temperature than UHMWPE.

In the case of sliding anti-seismic isolators such as pendulum isolators, by effect of the dissipation of energy in the form of heat produced through the friction between sliding surfaces, the temperature of the sliding surfaces can rise up to very huge values, much higher than the ambient temperature, reaching peaks of up to 200° C. and beyond, and in any case higher than the softening temperature of UHMWPE, consequently justifying the choice of PA6.

On the other hand, some of the drawbacks of PA6 are the poor ductility of the material, with related problems connected to the forming and manufacturing of the sliding element, and an excessive hygroscopicity which makes the mechanical behaviour thereof more difficult to predict.

An aim of the present invention is to obviate the above-mentioned drawbacks and in particular to provide a sliding material the mechanical properties of which, for a use in a structural bearing or in an anti-seismic isolator, are less sensitive to temperature and to environmental humidity with respect to known sliding materials.

SUMMARY OF THE INVENTION

The above aim is achieved according to the present invention with a sliding bearing arranged for supporting civil or structural engineering works, such as for example buildings, bridges, silos, tanks or large-dimension cranes, nuclear reactors or components thereof, having the characteristics according to claim 1.

Further features of the device are the object of the dependent claims.

The advantages that can be achieved through the present invention will become more evident to the person skilled in the art, from the following detailed description of some particular embodiments, provided by way of non-limiting example, and described with reference to the following schematic drawings.

LIST OF FIGURES

DETAILED DESCRIPTION

Figure 1:
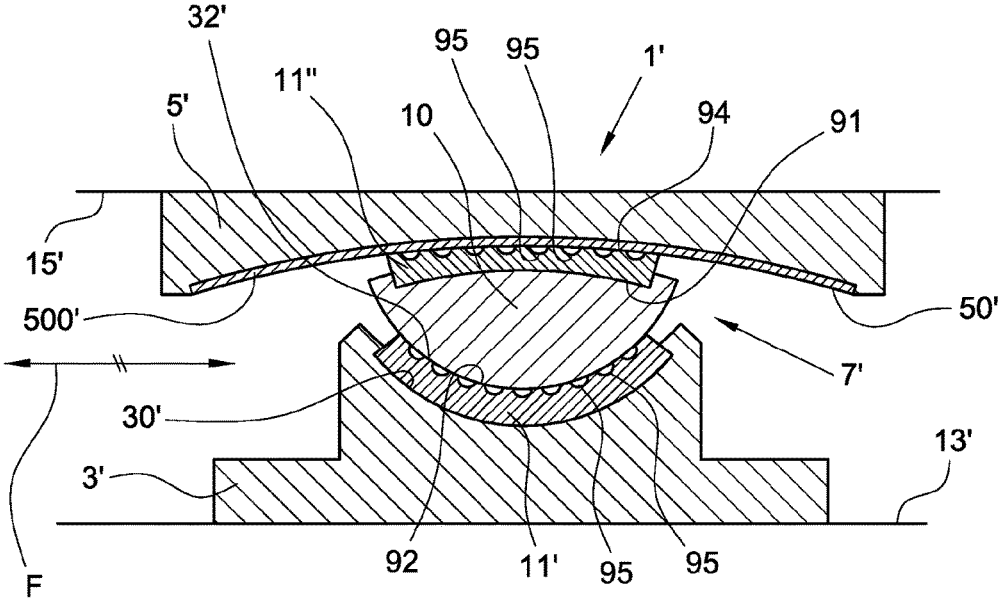
FIG. 1 shows a side view, partly sectioned, of a sliding bearing according to a first embodiment of the invention, made as a simple pendulum isolator.

FIG. 1 relates to a first embodiment of a sliding bearing according to the invention, denoted by the overall reference numeral 1'.

The bearing 1' comprises a sliding element 7' interposed between the base 3' and the upper support 5' and comprising an internal core 10 made of a substantially more resistant and rigid material, for example stainless steel, other kinds of steel or other suitable metal materials, and two layers of sliding material 11', 11".

A first seating 30' is made in the base 3', in which a first layer 11' of sliding material 9 is inserted.

The upper face of the layer 11' and the upper support 5' form a first 32' and a second sliding surface 50' respectively, both having a substantially concave shape, for example two portions of spherical surfaces.

The larger lower face of the sliding element 7' forms a third sliding surface 92. A second seating 91 is made on the upper larger face of the element 7', in which a second layer 11" of sliding material 9 is inserted, for example interlocked or in any case integrally fixed.

The upper face of the layer 11" forms a fourth sliding surface 94. The two larger faces of the sliding element 7' are arranged on two opposite sides of the element 7', which can for example have a substantially lenticular shape, with a greater or smaller convexity.

The surfaces 92, 94 are both convex and complementary x to the first 32' and the second sliding surface 50' respectively.

The third sliding surface 92 couples with and rests against the first sliding surface 32'; the fourth sliding surface 94 couples with and rests against the second sliding surface 50'.

The concavity of the surface 32' and convexity of the surface 92 can be significantly more accentuated than the concavity of the surface 50' and the convexity of the surface 94; for example the radius of curvature of the surfaces 50', 94 are about at least double, and preferably at least three times greater than the radius of curvature of the surfaces 32', 92, so that during a seismic event the sliding element 7' can rotate in the recess formed by the surface 32' but does not translate with respect to the base 3, while it can both rotate in the concavity formed by the surface 50' and translate with respect to the upper support 5, i.e. functioning as an anti-seismic isolator known as a pendulum bearing of the type described for example in publication U.S. Pat. No. 4,644,714.

The radii of curvature of the surfaces 50', 94 can be for example in the order of about 2-4 meters.

In an aspect of the invention, the sliding material 9 comprises:

- a content by weight equal to or greater than 50% wt of one or more fluorinated polymers;
- a content by weight comprised between 1-20% wt of boron nitride.

The sliding material 9 preferably has a content by weight equal to or greater than 50% wt of polytetrafluoroethylene (PTFE).

Other fluorinated polymers contained in the sliding material can be for example perfluoroalkoxy (PFA), poly(fluorinated ethylene propylene) (FEP) or poly(ethylene-co-tetrafluoroethylene) (ETFE).

The sliding material preferably has a content by weight comprised between 1-15% wt (the symbol % wt relates to the percentage in total weight) of boron nitride in hexagonal form, more preferably comprised between 1-10% wt and still more preferably comprised between 2-8% wt.

It has been observed in particular that a content of boron nitride in hexagonal form lower than 10% in weight enables PTFE to maintain an acceptable ductility, with a strain at failure of about 300% under tensile stress.

A content of boron nitride in hexagonal form comprised between 2-5% or 3-5% wt enables having a coefficient of friction comprised between 3% and 5%, which is advantageously convenient for use in anti-seismic isolators, providing an ideal compromise between the dissipation of seismic energy, which requires high friction values, and the resistance to sliding in the presence of slow non-seismic movements, which requires low friction values.

When on the other hand the anti-seismic isolator is used for example for the protection of buildings and structures lying in highly seismicity zones where high-energy seismic events are very likely to occur, it is advantageous to increase the dissipation ability of the isolator by employing higher coefficients of friction, for example around 6-7%, which can be attained through a content of boron nitride in hexagonal form comprised for example between 6-10% wt and more preferably between 7-10% wt.

The use of boron nitride in hexagonal form as a filler of a fluoropolymer, in particular of PTFE, provides the following advantages:

(a) an increased coefficient of friction with respect to pure PTFE and consequently increased dissipating capacity;

(b) increased compressive strength with respect to that of pure PTFE;

(c) increased heat conductivity, useful for dissipating the heat produced by friction during the seismic event;

(d) increased resistance to wear with respect to pure PTFE:

(e) a non-significant alteration in the dielectric properties of the material with respect to pure PTFE.

The use of boron nitride in the sliding material has been observed to be advantageous with respect to the use of other fillers already proposed in the past for use in PTFE based sliding materials.

With respect to graphite, if used as a filler in a sliding material, the boron nitride has greater thermal stability—it decomposes at temperatures higher than 850° C.—has superior chemical stability and is dielectric and therefore its presence as a filler does not entail a significant alteration of dielectric properties with respect to pure PTFE, unlike graphite which is instead an excellent electrical conductor.

The dielectric properties of the sliding material are an important requirement for the use of the material in the bearings used, for example in supports for railway lines, where the line must be electrically insulated with respect to the ground.

With respect to bronze, use of which has been proposed as a filler of the sliding material, for example in publication WO 2012/114246A1, the use of boron nitride enables obtaining values of the coefficient of friction that are significantly lower and not excessively high and further enables preserving the ductility of the material.

The hexagonal boron nitride contained in the sliding material 9 preferably has a mean particle size comprised between 3-14 micron, where the particle size can be measured for example using the laser diffraction method as described in standard ISO 13320.

To further increase the compressive strength, the sliding material advantageously has a content by weight comprised between 1-20% of carbon fibres and/or wollastonite fibres.

The sliding material preferably has a content by weight comprised between 2-7% of carbon fibres and/or wollastonite fibres.

Carbon fibres have a length preferably comprised between 0.01-2 mm. Wollastonite fibres have a length preferably comprised between 0.01-1 mm.

The content of PTFE or other fluorinated polymers in the sliding material 9 can be the 100's complement of the content of boron nitride and carbon fibres, wollastonite and other fillers that might be present. The carbon fibres enable an increase in the compressive strength of about 10% with respect to the wollastonite fibres.

To reduce the coefficient of friction, in the illustrated embodiments, a plurality of recesses 95 is present on the sliding surfaces 32, 32' and 94, which recesses are for example in the form of small cups, filled with silicone grease or another fluid lubricant.

In other embodiments, not illustrated, the sliding surfaces present in the sliding material 9 can in any case be free from fluid lubrication and operate under dry friction.

More generally a sliding material according to the invention can internally comprise a fluid lubricant, such as for example (poly)dimethylsiloxane or more in general a silane, so as to lower the high breakaway coefficient of friction typical of PTFE.

The advantages of the previously described sliding material with respect to the known materials can be summarised as follows.

With respect to PTFE:

- increased compressive strength due to the boron nitride and the fibres and therefore increased load bearing capacity given equal dimensions;
- increased resistance to wear and therefore durability;
- higher coefficient of friction and therefore greater ability to dissipate the energy from the seismic event;
- superior ability to dissipate the heat produced by friction due to the presence of boron nitride.

With respect to UHMWPE:

- superior resistance at high temperatures (the softening temperature is higher than 320° C. with respect to 135° C. of UHMWPE) and therefore the possibility of achieving higher coefficients of friction; as the power dissipated in the form of heat is approximately equal to the product of the coefficient of friction, the pressure and the velocity, with UHMWPE if friction is increased the pressure must consequently be reduced (and therefore the dimension of the surface increased) so as to avoid overheating and loss of strength.

With respect to polyamide (PA):

- absence of hygroscopicity and therefore improved dimensional stability;
- lower modulus of elasticity and therefore ability to uniformly distribute pressure on the surface, avoiding wear localised in the zones of greater pressure.

Figure 2:
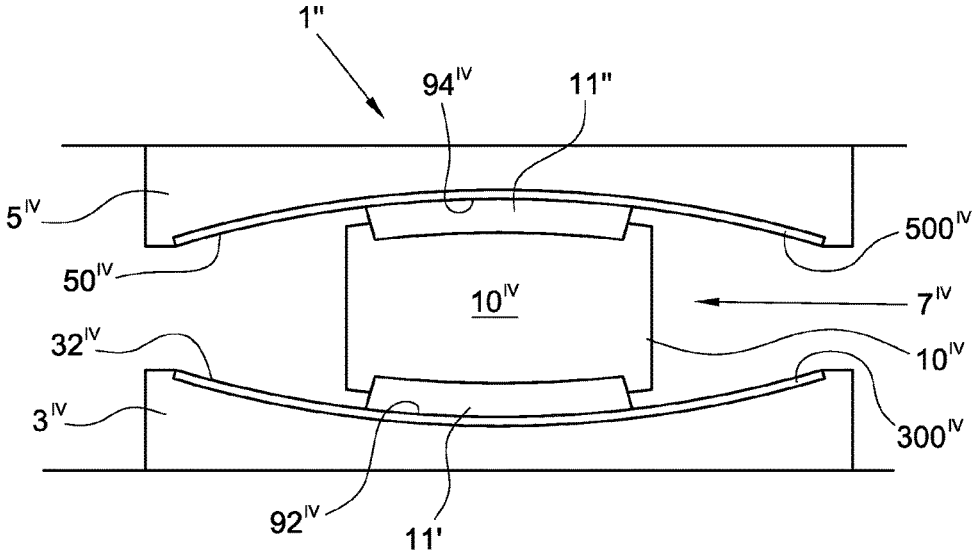
FIG. 2 shows a side view, partly in section, of a sliding bearing according to a second embodiment of the invention, made as a double pendulum isolator with no rotation joint.

FIG. 2 illustrates a sliding bearing, denoted by the overall reference numeral 1", in a second embodiment according to the invention.

Like the bearing 1' of FIG. 1, also the bearing 1" of FIG. 2 forms a simple pendulum isolator; however, differently to the bearing 1', the bearing 1" is arranged for enabling only the translation and the reciprocal rotation between the two parts connected by the bearing, in particular between the base $\mathbf{3}^{IV}$ and the upper support $\mathbf{5}^{IV}$.

The bearing 1" is provided with a sliding element $\mathbf{7}^{IV}$ between the base $\mathbf{3}^{IV}$ and the upper support $\mathbf{5}^{IV}$, which sliding element $\mathbf{7}^{IV}$ in turn comprises an internal core $\mathbf{10}^{IV}$ and two layers 11', 1" made of the sliding material 9 described in the present application and fixed to the internal core $\mathbf{10}^{IV}$.

The two layers of sliding material 11', 1" slide on a first $\mathbf{32}^{IV}$ and on a second sliding surface $\mathbf{50}^{IV}$ respectively, the first being made on the base $\mathbf{3}^{IV}$ and the second on the upper support $\mathbf{5}^{IV}$.

The larger lower face of the layer 11' is indicated in the present description as the "third sliding surface $\mathbf{92}^{IV}$ and is arranged for sliding against the first sliding surface $\mathbf{32}^{IV}$.

The upper larger face of the layer 11" is indicated in the present description as the "fourth sliding surface $\mathbf{94}^{IV}$ and is arranged for sliding against the second sliding surface $\mathbf{50}^{IV}$.

Figure 3:
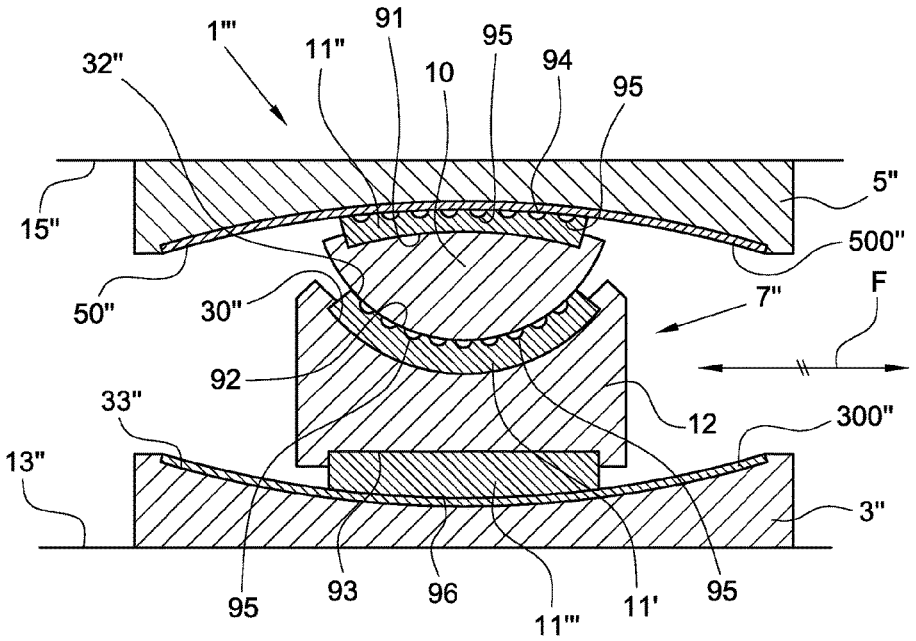
FIG. 3 shows a side view, partly in section, of a sliding bearing according to a third embodiment of the invention, made as a double pendulum isolator with a rotation joint.

While FIGS. 1 and 2 respectively illustrate a simple pendulum isolator and a double pendulum isolator, FIG. 3 relates to a third embodiment of a sliding bearing, denoted by reference numeral 1'" and comprising a sliding element 7" interposed between the base 3" and the upper support 5" and comprising an internal core 10 made of a substantially stronger and more rigid material, for example a stainless steel, other types of steel or other appropriate metal materials, and two layers of sliding material 11', 11".

A first seating 30" is made in the base 3", in which a first layer 11' of sliding material 9 is inserted.

The upper face of the layer 11' and the upper support 5" form respectively a first 32" and a second sliding surface 50", both having a substantially concave shape, for example two portions of spherical surfaces.

The larger lower face of the sliding element 7" forms a third sliding surface 92.

A second seating 91 is made on the upper larger face of the element 7', in which a second layer 11" of sliding material 9 is inserted, for example interlocked or in any case integrally fixed.

The upper face of the layer 11" forms a fourth sliding surface 94.

The two larger faces of the sliding element 7' are arranged on two opposite sides of the element 7' itself, which can for example have a substantially lenticular shape, with a greater or smaller convexity.

The surfaces 92, 94 are both convex and complementary to the first 32" and the second sliding surface 50" respectively.

The third sliding surface 92 couples with and rests against the first sliding surface 32". The fourth sliding surface 94 couples with and rests against the second sliding surface 50".

The bearing 1'" is shaped as a so-called double pendulum isolator with a rotation joint, in which the sliding element 7" comprises not only the internal core 10 but also the sliding block 12.

The core 10 rests on the sliding block 12, which in turn rests on the fifth sliding surface 33" made on the base 3".

The sliding surface 33", substantially concave, has a greater mean or minimum radius of curvature similar to that of the second sliding surface 50" and large enough to enable the sliding block 12, and consequently the core 10, to slide thereon (Arrow F).

A seating 30" having a greater concavity is instead made in the upper part of the sliding block 12, in which a first layer 11' of sliding material 9 is solidly rested and fixed.

The layer 11', like the surface 32' of the isolator 1', houses the core 10, enabling a variation in the inclination with respect to the sliding block 12 while solidly following the lateral translation movements thereof with respect to the base 3" (Arrow F).

The isolator 1" thus performs as a hinge, possibly spherical, mounted on a carriage.

The second layer 11" of sliding material 9 can be for example rested and fixed solidly to the upper larger face of the core 10, for example inserted and/or interlocked in a seating 91 made on said larger face.

A seating 93 is present on the lower part of the sliding block 12 in which a third layer 11" is inserted and solidly fixed, made for example in the sliding material 9.

The lower surface of the layer 11" forms a sixth sliding surface 96 which rests and slides on the surface 33" of the base.

The sixth sliding surface 96, as well as the third and the fourth sliding surface 94 are made of the sliding material 9, as described in the foregoing.

Figure 4:
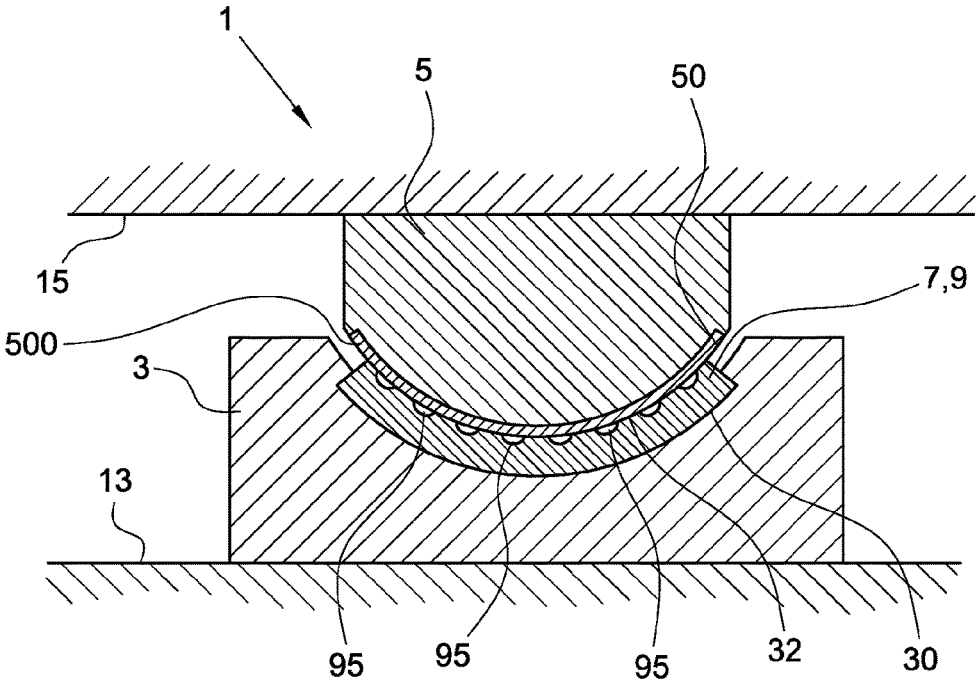
FIG. 4 shows a side view, partly in section, of a sliding bearing according to a fourth embodiment of the invention, made as a spherical bearing.

FIG. 4 relates to a fourth embodiment of a sliding bearing, denoted by the overall reference numeral 1, according to the invention.

The bearing 1 can be used as a structural bearing arranged for supporting civil or structural engineering works, such as for example bridges or buildings, tanks or silos with seismic base isolation and is arranged for providing a hinge constraint without having dissipation of seismic energy as a main function.

the bearing 1 comprises:

a base 3 and an upper support 5;

a sliding element 7 interposed between the base 3 and the upper support 5, and against which the base 3 and the upper support 5 rest.

The base 3 and the upper support 5 can be made for example as solid plates or solid blocks of steel or another appropriate metal material.

The sliding element 7 can be formed by a simple sheet or shell of sliding material 9 as previously described, formed separately and subsequently interposed between the base and the support 5.

A first rest surface 30 having a substantially concave shape can be made in the base 3, on which a layer of sliding material 9 is rested (FIG. 4).

The sliding material is preferably integrally constrained to one of the two surfaces 30, 50, for example to the rest surface 30 as it is interlocked thereto. The upper surface of the element 7 of the sliding material 9 forms a first sliding surface 32.

Correspondingly a second sliding surface 50 can be made on the upper support 5, having a substantially convex shape and arranged for coupling with the first sliding surface 32 and for sliding thereon (FIG. 4).

If the surfaces 32 and 50 are spherical, the bearing 1 can be used as a so-called spherical bearing arranged for providing a spherical hinge constraint.

The bridge, tank, silo or other construction 15 to be supported is rested on the upper support 5 and made solid thereto, while the base 3 can rest on an underlying ground, pavement, pillar or other basement 13.

The sliding surfaces 32, 50 can have rated or mean radiuses of curvature for example equal to or smaller than 1.5 meters.

In an embodiment (not shown) the two sliding surfaces 32, 50 can be substantially flat, and the bearing provides a sliding support constraint suitable for displacing horizontally or in any case in a plane with one or two degrees of freedom of sliding.

The sliding material 9 can be obtained from a plate or sheet, cut therefrom and then interposed in a cold process between the coupling surfaces:

between the base 3, 3', 3", $3^{IV}$ and the upper support 5, 5', 5", $5^{IV}$; and/or between the sliding element 7, 7', 7", $7^{IV}$ and the base 3', 3", $3^{IV}$, the upper support 5' or the sliding block 12 and/or between the sliding block 12 and the base 3".

In general the sliding material 9 can be for example a plate or sheet made of a solid material, obtained for example by compression moulding or sinterization.

The sliding material 9 can be for example a plate or sheet having a thickness comprised for example between 1-30 millimeters or between 2-15 millimeters.

The sliding material 9 can be for example a plate or a sheet of solid and substantially non-porous material, this meaning that:

the sliding material 9 does not internally form a plurality of cavities communicating with one another of the type that is obtained for example by sintering a granular or powdery material; and/or the sliding material 9 has an effective porosity, understood as the ratio between the volume of the intercommunicating pores only and the of overall total volume of the piece of sliding material 9 considered, equal to or less than 10%, more preferably equal to or less than 5% and even more preferably equal to or lower than 1% of the overall total volume of the piece of sliding material 9.

The substantially compact and non-porous structure of the sliding material 9 enables it to function without being impregnated with liquid lubricants, having coefficients of friction that are suitably high and advantageous, for example for dissipating the energy of an earthquake, and instead not excessively low.

In order to be able to conform in a cold cold processing to the shape of the base 3, 3', 3", $3^{IV}$ of the upper support 5, 5', 5", $5^{IV}$, of the internal core or of the sliding block 12, as well as for redistributing more uniformly the internal pressures the material 9 has a sufficient ductility.

Alternatively however the sliding material 9 can be applied on the relevant surfaces of the bearing through different processes, for example by compression or injection co-moulding.

The surfaces 50, 50', 92, 33", 50", $32^{IV}$, $50^{IV}$, on which they rest, and on which the sliding material elements 9 slide are preferably made of a metal material, such as for example stainless steel, other types of steel or other ferrous or non-ferrous metals such as for example aluminium and its alloys.

The surface 50, 50', 92, 33", 50", $32^{IV}$, $50^{IV}$ can be made for example of the same material of which the base 3, 3', 3", $3^{IV}$ the upper support 5, 5', 5", $5^{IV}$ or the core 10, 10', $10^{IV}$ are made, and can be formed from said supports or base as a single piece; in this case the surfaces 50, 50', 92, 33", 50", $32^{IV}$, $50^{IV}$ can be made for example by hard chrome plating, anodising or nickel-plating surface treatments.

The surfaces 50, 50', 92, 33", 50", $32^{IV}$, $50^{IV}$ can also be made as plates 300', 300", $300^{IV}$, 500, 500', 500", $500^{IV}$, sheets or other inserts fixed to the base 3, 3', 3", $3^{IV}$, on the upper support 5, 5', 5", $5^{IV}$ and/or on the core 10, 10', $10^{IV}$ and fixed thereto for example by welding, screws, nails, rivets or by being simply mechanically connected thereto.

Indicatively a bearing according to the invention, in particular the structural bearing 1 or the f pendulum isolators 1', 1", 1'" can be suitable for supporting a design static vertical load comprised between a few kN and for example 100,000 kN.

The sliding material 9 previously described is not hygroscopic, and can have coefficients of friction that are not excessively high, being around the order of 0.03-0.1 if used in a pendulum isolator, and the compressive strength thereof decays as a function of the temperature in a less marked way with respect for example to UHMWPE; in fact, in a particular embodiment of the invention it was possible to obtain a sliding material 9 with a compressive strength of at least about 120 Mpa at 70° C., against a strength of 90 MPa of UHMWPE at the same temperature, where such temperatures are those of the material itself during the compressive strength test.

The combined presence of hexagonal boron nitride and of a filler such as carbon fibres or wollastonite fibres further enables increasing the resistance to wear and the ductility of the material 9 with respect for example to pure fluorinated polymers.

The embodiments previously described are susceptible to various modifications and variations without departing from the scope of protection of the present invention.

For example the concavities or convexities of the sliding surfaces 32, 50, 32', 50', 92, 94, 96, 33" can be inverted with respect to the preceding description and figures. If used for example for bearings for bridges, the sliding material 9 can contain further solid lubricants as fillers such as for example molybdenum disulphide (MoS2) or talc.

The sliding surfaces previously described can have concave or convex shapes, and can for example be portions of spherical surfaces or cylindrical surfaces, or can also be flat according to needs and the position thereof in the bearing. Moreover, all details may be replaced with other technically equivalent elements. For example the materials used, as well as the dimensions, can be any according to the technical needs. It is understood that an expression of the type "A comprises B, C, D" or "A is formed by B, C, D" also comprises and describes the particular case in which "A is constituted by B, C, D". It is understood that the examples and lists of possible variants of the present application are to be taken as non-exhaustive.

The invention claimed is:

1. A sliding bearing arranged for supporting a civil or structural engineering work, the hearing comprising:
- a base and an upper support;
- a sliding element interposed between the base and the upper support, and against which the base and the upper support rest;
- and wherein the sliding element comprises at least one layer made of a sliding material comprising:
- a content by weight equal to or greater than 50% wt of one or more fluorinated polymers;
- a content by weight comprised between 1-20% wt of boron nitride in hexagonal form.

2. The bearing according to claim 1, wherein the sliding material has a content by weight equal to or greater than 50% wt of polytetrafluoroethylene.

3. The bearing according to claim 1, wherein the sliding material has a content by weight comprised between 1-20% of carbon fibres.

4. The bearing according to claim 1, wherein the sliding material has a content by weight comprised between 1-20% of wollastonite fibres.

5. The bearing according to claim 1, wherein the sliding material has a content by weight comprised between 1-15% wt of boron nitride.

6. The bearing according to claim 1, wherein the sliding material has a content by weight comprised between 1-10% wt of boron nitride in hexagonal form.

7. The bearing according to claim 1, wherein the sliding material has a content by weight comprised between 2-5% wt or between 6-10% wt of boron nitride in hexagonal form.

8. The bearing according to claim 1, wherein the sliding material has a content by weight comprised between 2-7% of carbon fibres and/or wollastonite fibres.

9. The bearing according to claim 1, wherein the sliding material at 70° C. has a compressive strength of at least 120 MPa.

10. The bearing according to claim 1, wherein:
- the base forms a first sliding surface;
- the upper support forms a second sliding surface;
- the sliding element interposed between the first sliding surface and the second sliding surface, and rests against them;
- at least one of the first sliding surface and the second sliding surface has a substantially flat shape.

11. The bearing according to claim 1, wherein:
- the base forms a first sliding surface;
- the upper support forms a second sliding surface;
- the sliding element is interposed between the first sliding surface and the second sliding surface, and rests against them;
- at least one of the first sliding surface and the second sliding surface has a concave shape.

12. The bearing according to claim 11, wherein:
- the sliding element forms two larger faces forming respectively a third sliding surface and a fourth sliding surface;
- the first sliding surface rests against the third sliding surface;
- the second sliding surface rests against the fourth sliding surface;
- at least one of the third has a convex shape.

13. The bearing according to claim 12, wherein at least one of the third and the fourth sliding surface are obtained from a layer made of the sliding material.

14. The bearing according to claim 1, wherein:
- the base or the upper support forms a first sliding surface;
  - the sliding element is interposed between the base and the upper support and forms a second sliding surface;
  - at least one of the first and the second sliding surface has a substantially flat shape.

15. The bearing according to claim 1, wherein:
- the base forms a first sliding surface;
  - the sliding element is interposed between the base and the upper support and forms a second sliding surface;
  - at least one of the first and the second sliding surface has a substantially concave or convex shape, and forms a portion of a spherical surface.

16. The bearing according to claim 1, wherein the bearing is a seismic isolator.

17. The bearing according to claim 1, wherein the civil or structural engineering work is a bridge, building, silo, tank, crane, nuclear reactor, or a component thereof.

* * * * *